US006940232B1

(12) United States Patent
Kong

(10) Patent No.: US 6,940,232 B1
(45) Date of Patent: Sep. 6, 2005

(54) ELECTRODELESS FLUORESCENT LAMP

(75) Inventor: Qin Kong, San Diego, CA (US)

(73) Assignee: Fujian Juan Kuang Yaming Electric Limited, Fujian (CN)

( * ) Notice: Subject to any disclaimer, the term of this patent is extended or adjusted under 35 U.S.C. 154(b) by 0 days.

(21) Appl. No.: 10/788,662

(22) Filed: Feb. 27, 2004

(51) Int. Cl.[7] ..... H05B 41/16; H01J 61/18
(52) U.S. Cl. ..... 315/248; 313/638
(58) Field of Search ..... 315/56, 248; 313/631, 313/634, 638, 231.41

(56) References Cited

U.S. PATENT DOCUMENTS 4,571,526 A * 2/1986 Wesselink ..... 315/56
5,412,280 A * 5/1995 Scott et al. ..... 313/573
6,081,070 A * 6/2000 Popov et al. ..... 313/490
6,522,084 B1 * 2/2003 Miyazaki et al. ..... 315/248
6,734,616 B2 * 5/2004 Lankhorst et al. ..... 313/490

* cited by examiner

*Primary Examiner*—Don Wong
*Assistant Examiner*—Minh Dieu A
(74) *Attorney, Agent, or Firm*—Raymond Y. Chan; David and Raymond

(57) ABSTRACT

An electrodeless fluorescent lamp includes a glass vessel having a retention channel and a vapor chamber for sealedly storing an active vapor therein; a thermal conductive unit disposed within the retention channel; an induction coil supported by the thermal conductive unit within the retention channel, wherein the heating coil is arranged to generate heat towards the vapor chamber for emitting light from the active vapor; and a ventilation arrangement having a ventilation channel enclosed by the glass vessel to extend from the retention channel to an exterior of the glass vessel for ventilating excess heat from the induction coil within the retention channel to outside.

20 Claims, 3 Drawing Sheets

ELECTRODELESS FLUORESCENT LAMP

BACKGROUND OF THE PRESENT INVENTION

1. Field of Invention

The present invention relates to a lamp, and more particularly to an electrodeless fluorescent lamp having a ventilation channel which is adapted to remove most of the heat from a heating coil of the electrodeless fluorescent lamp.

2. Description of Related Arts

Electrodeless fluorescent lamp was discovered 100 years age by Hittorf. Since then, hundreds of patents and all kinds of electrodeless lamps have been filed and developed. However the functions of these electrodeless lamp and systems are still not very good yet.

Referring to FIG. 1 of the drawings, a conventional electrodeless induction-coupled fluorescent lamp 1P is illustrated. The electrodeless induction-coupled fluorescent lamp 1P comprise a glass vessel 10P which encloses a predetermined amount of mercury vapor and a buffer gas or gases and a phosphor or a phosphor with protection coating, a reentrant channel 20P, a heating coil 30P, an optional ferrite 40P, a metal rod 50P, a metal base 60P and a glass vessel support 70P. The heating coil 30P generates RF energy and induction-coupled plasma producing Ultra-Violet (UV) light inside the glass vessel 10P. The phosphor converts the UV to visible light. The metal rod 50P removes the heat from the heating coil 30P through the glass vessel support 70P.

U.S. Pat. No. 5,105,122 of Konings et al discloses another kind of electrodeless induction-coupled fluorescent lamp, in which the lamp comprises a glass vessel, a coil, a ferrite rod, and a base. The heat generated by the coil and the plasma is conducted out through the ferrite rod, which is not a good thermal conductor. This lamp has a higher temperature at the coil and cavity. Therefore the lamp has higher loss and low operation efficiency.

U.S. Pat. No. 5,355,054 of Lierop et al yet discloses another type of electrodeless induction-coupled fluorescent lamp which has a similar structure as shown in FIG. 1 of the drawings. The central rod is replaced by a cooling body, which is gas tight. The cooling body includes a condenser, an evaporator, a liquid, and a capillary structure. The liquid cooling system very efficiency, very expansive, and relatively complex in construction. Because of the limited space, this cooling system only can remove limited heat from the coil and the plasma to the base. This lamp still has a higher temperature at the coil and cavity. Therefore the lamp has higher loss and low efficiency.

U.S. Pat. No. 5,572,083 of Antonis at el. discloses another type of electrodeless induction-coupled fluorescent lamp which comprises a glass vessel, a coil, a ferrite, a rod, and a base. The heat generated by the coil and the plasma is conducted out through the rod. Because of the limited space, the size of the rod is limited. The rod only can remove limited heat from the coil and the plasma to the base. This lamp still has a higher temperature at the coil and cavity. Therefore the lamp has higher loss and low efficiency.

U.S. Pat. Nos. 5,621,266 and 5,723,947, both of Popov at el., disclose another type of electrodeless induction-coupled fluorescent lamp which comprise a glass vessel, a coil, a metal pipe, and a base or fixture. The heat generated by the coil and the plasma is conducted out through the metal pipe. Because of the limited space, the thickness of the metal pipe is limited. The metal pipe only can remove limited heat from the coil and the plasma to the base or the fixture. This lamp still has a higher temperature at the coil and cavity. Therefore the lamp has higher loss and low efficiency.

U.S. Pat. No. 6,081,070 of Popov at el. discloses another type of electrodeless induction-coupled fluorescent lamp which comprises a glass vessel, a coil, a ferrite core, a metal pipe, and a base or fixture. The heat generated by the coil and the plasma is conducted out through the ferrite core and the metal pipe. Because of the limited space, the thickness of the metal pipe is limited. The metal pipe only can remove limited heat from the coil and the plasma to the base or the fixture. This lamp still has a higher temperature at the coil and cavity. Therefore the lamp has higher loss and low efficiency.

U.S. Pat. No. 6,555,954 of Chandler at el. discloses another type of electrodeless induction-coupled fluorescent lamp which comprises a glass vessel, a coil, a ferrite core, a metal pipe, and a base or fixture. The heat generated by the coil and the plasma is conducted out through the ferrite core and the metal pipe. Because of the limited space, the thickness of the metal pipe is limited. The metal pipe only can remove limited heat from the coil and the plasma to the base or the fixture. In this patent, the glass vessel was glued to the base to get better heat sink. However, the base size is limited and removing additional heat is limited. This lamp still has a higher temperature at the coil and cavity. Therefore the lamp has higher loss and low efficiency.

All the above-mentioned arts utilize a metal rod or pipe to conduct (i.e. remove) heat from the center of the lamp to the base or to the outside. However, because of structure limitation, this kind of heat reduction mechanism is certainty not good enough to adequately reduce the temperature of the coil and the glass vessel.

SUMMARY OF THE PRESENT INVENTION

A main object of the present invention is to provide an electrodeless fluorescent lamp having a ventilation channel which is adapted to substantially remove most of the heat from a heating coil of the electrodeless fluorescent lamp.

Another object of the present invention is to provide an electrodeless fluorescent lamp which substantially overcomes a traditional limitation of heat reduction in a conventional electrodeless fluorescent lamp arising from the geometry thereof so as to significantly enhance an effectiveness and efficiency of the electrodeless fluorescent lamp.

Another object of the present invention is to provide an electrodeless fluorescent lamp which is adapted to physically direct heat generated from the heating coil to an outside of the lamp through the ventilation channel. In other words, no extra heat conducting element is required.

Another object of the present invention is to provide an electrodeless fluorescent lamp which does not involve any complicated and expensive electrical or mechanical components so as to minimize the manufacturing cost and the ultimate selling price of the present invention.

Accordingly, in order to accomplish the above objects, the present invention provides an electrodeless fluorescent lamp, comprising:

a glass vessel having a retention channel and a vapor chamber for sealedly storing an active vapor therein;

a thermal conductive unit disposed within the retention channel;

an induction coil supported by the thermal conductive unit within the retention channel, wherein the induction coil is arranged to generate heat towards the vapor chamber for emitting light from the active vapor; and a ventilation arrangement having a ventilation channel enclosed by the glass vessel to extend from the retention channel to an exterior of the glass vessel for ventilating excess heat from the induction coil within the retention channel to outside.

These and other objectives, features, and advantages of the present invention will become apparent from the following detailed description, the accompanying drawings, and the appended claims.

DETAILED DESCRIPTION OF THE PREFERRED EMBODIMENT

Figure 2:
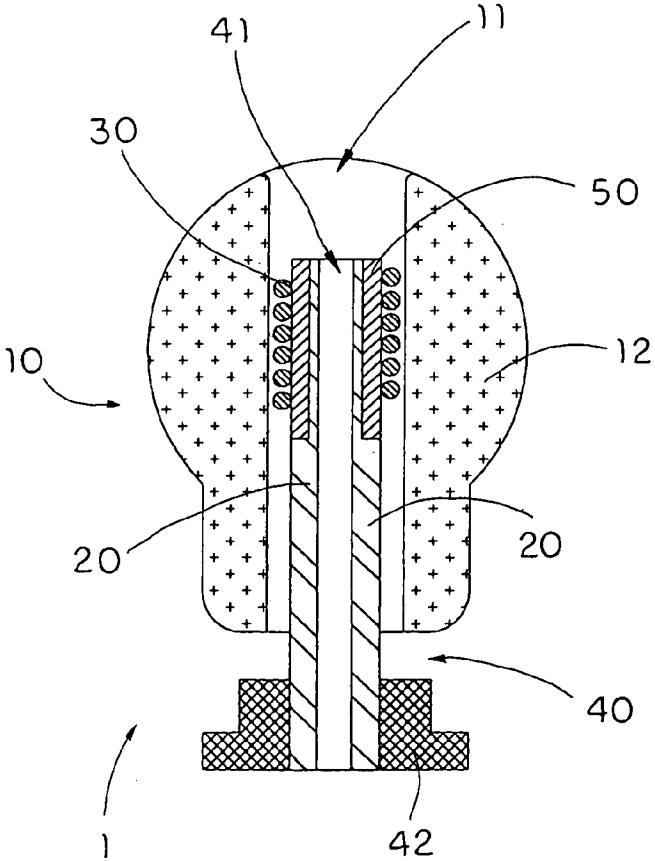
FIG. 2 is a sectional view of an electrodeless fluorescent lamp according to a first preferred embodiment of the present invention.
Figure 1:
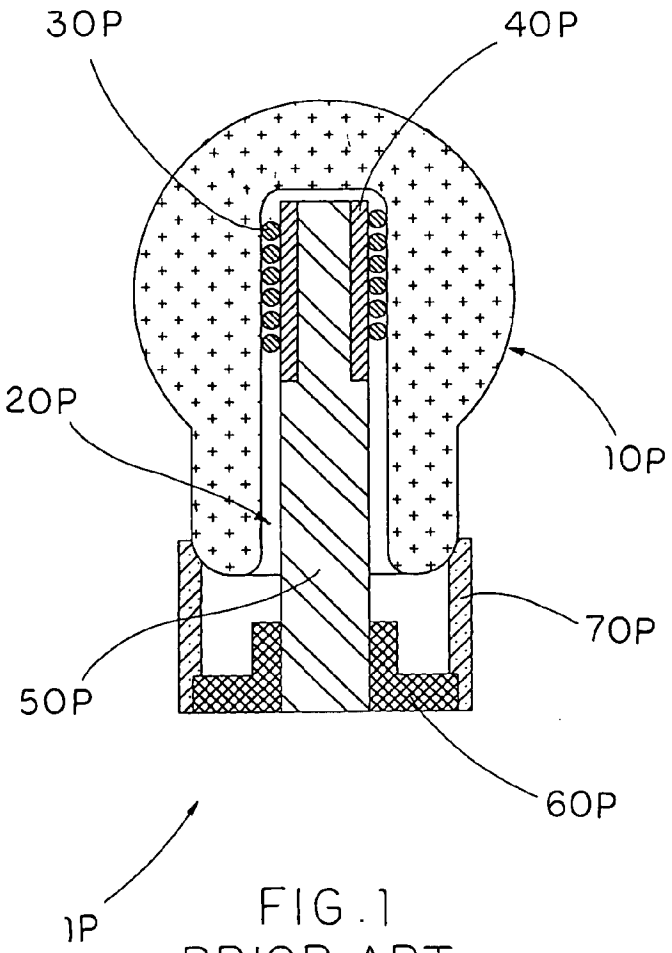
FIG. 1 PRIOR ART
FIG. 1 is sectional view of a conventional electrodeless fluorescent lamp.

Referring to FIG. 2 of the drawings, an electrodeless fluorescent lamp 1 according to a first preferred embodiment of the present invention is illustrated, in which the electrodeless fluorescent lamp 1 comprises a glass vessel 10, a thermal conductive unit 20, an induction coil 30, and a ventilation arrangement 40.

The glass vessel 10 has a retention channel 11 and a vapor chamber 12 for sealedly storing an active vapor therein. The active vapor is preferably embodied as mercury vapor in the form of an induction-coupled plasma, and that a phosphor layer is coated on the vapor chamber 12 for facilitating generation of illumination. Moreover, the retention channel 11 and the vapor chamber 12 are thermally communicated with each other such that heat is adapted to transferred from the retention channel 11 to the vapor chamber 12 for energizing the mercury vapor therewithin.

The conductive unit 20 is disposed in the retention channel 11 for transferring heat from the induction coil 30 to the ventilation arrangement 40 which significantly reduces and directs the amount of heat inside the retention channel 11 to an outside of the glass vessel 10. Accordingly, the conductive unit 20 is made from good heat conductive materials, such as metal, in which the heat generated at the induction coil 30 is capable of being effectively transferred to the ventilation arrangement 40.

The induction coil 30 is supported by the thermal conductive unit within the retention channel 11, wherein the induction coil 30 is arranged to generate heat towards the vapor chamber 11 for emitting light from the active vapor. In particular, the induction coil 30 is adapted to generate Radio Frequency (RF) energy to induction-coupled plasma, i.e. the mercury vapor, inside the vapor chamber 12. The mercury vapor inside the vapor chamber 12 becomes in a state of plasma which is arranged to generate ultraviolet radiation (UV light). At the same time, the phosphor coating on the vapor chamber 12 converts the UV light to visible light for providing illumination.

Referring to FIG. 2 of the drawings, the ventilation arrangement 40 has a ventilation channel 41 enclosed by the glass vessel 10 to extend from the retention channel 11 to an exterior of the glass vessel 10 for ventilating excess heat from the induction coil 30 within the retention channel 11 to an outside of the glass vessel 10, i.e. the ambient atmosphere in which the electrodeless fluorescent lamp 1 of the present invention is implemented.

The technical operation of the electrodeless fluorescent lamp 1 is elaborated as follows: Basically, the lamp 1 is a temperature dependent device, the performance of which being largely dependent on the lamp's 1 temperature. The main heat source is the induction coil 30, at which the peak temperature can be as high as around 200° C., whereas the temperature of the glass surrounding the vapor chamber 11 may as high as around 100° C.

Since the ventilation channel 41 extends from the induction coil 30 to an outside of the glass vessel 1 through a bottom end of the ventilation channel 41, as a result, as the induction coil 30 reaches the high temperature, the significant temperature different between the induction coil 30 and the ambient atmosphere at two ends portions of the ventilation channel 41 drives substantial heat transfer therebetween. From simple heat transfers theory, one skilled in the art would easily appreciate that the heat transfers taken place inside the ventilation channel 41 by the hot air convecting through the ventilation channel 41. The large temperature difference will create a high-speed air motion inside the ventilation channel, in which the moving of air molecules can facilitate the heat transfers more efficiently and effectively.

According to the first preferred embodiment, the ventilation channel 41 is formed and longitudinally extended along the thermal conductive unit 20 to reach an outside of the glass vessel 10 through a bottom end portion of the retention channel 11.

Referring to FIG. 2 of the drawings, the ventilation arrangement 40 further comprises a heat ventilating heat reservoir 42 provided at a bottom end portion of the ventilating channel 41 wherein the heat from the induction coil 30 is arranged to be transferred to this ventilating heat reservoir 42 which facilitates enhanced heat transfer between the ventilation channel and the ambient atmosphere.

Therefore, according to the first preferred embodiment of the present invention, the ventilating heat reservoir 42 is preferably embodied as a heat sink which is capable of facilitating enhanced heat transfer from the ventilation channel 41 to the ambient atmosphere in additional to the above-mentioned direct convective heat transfer from the ventilation channel 41 to an outside of the glass vessel 10.

Furthermore, the electrodeless fluorescent lamp 1 further comprises a ferrite conductor 50 supported by the thermal conductive unit 20 and is adapted to be utilized in a high-frequency application such as high frequency energy transmission. Therefore, the ferrite conductor 50 is adapted to facilitate energy transfer between the induction coil 30 and the thermal conductive unit 20. According to the first preferred embodiment, the induction coil 30 is arranged to contact with the ferrite conductor 50 for high frequency energy transfer.

Figure 3:
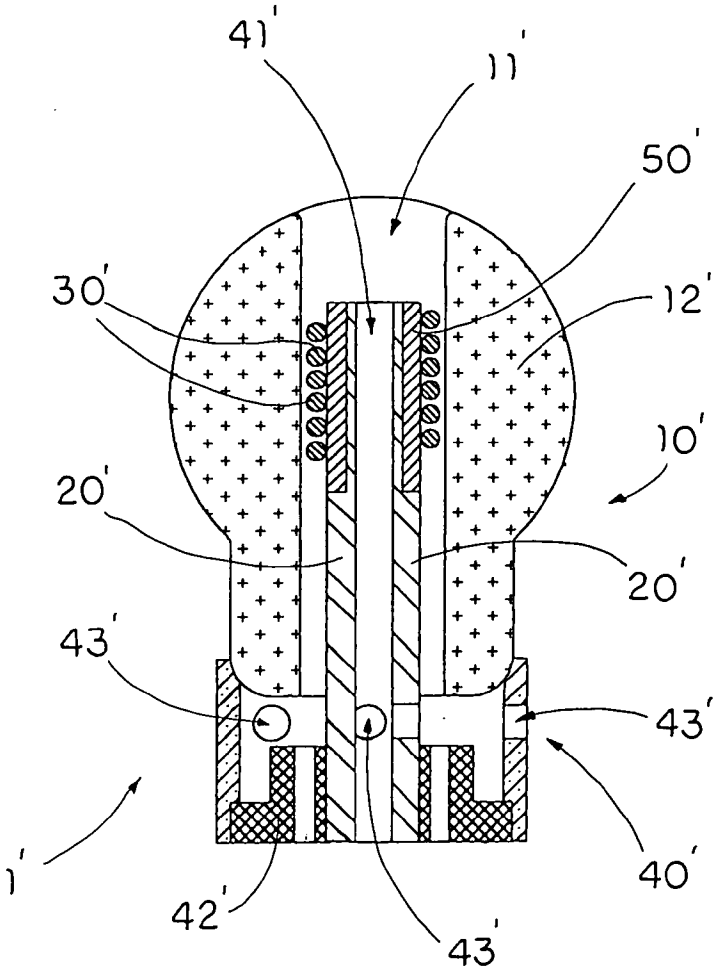
FIG. 3 is first alternative mode of the electrodeless fluorescent lamp according to the above first preferred embodiment of the present invention.

Referring to FIG. 3 of the drawings, a first alternative mode of the electrodeless fluorescent lamp 1' according to the first preferred embodiment of the present invention is illustrated. The first alternative mode is similar to the first preferred embodiment except the ventilation arrangement 40' and that the electrodeless fluorescent lamp 1' further comprises a supporting base 60'.

According to the first alternative mode of the present invention, the supporting base 60' is mounted at a bottom portion of the glass vessel 10'. Moreover, the ventilation arrangement 40' further contains a plurality of convencting holes 43' formed on the supporting base 60' wherein air is adapted to pass through the convecting holes 43', the retention channel 11', and the ventilating channel 41'.

In other words, the heat from the induction coil 30', the ferrite conductor 50', and the plasma of the mercury vapor in the vapor chamber 12' can be conducted through the thermal conductive unit 20', the supporting base 60' and taking place convective heat transfer through convecting holes and the ventilation channel 41' to reach an exterior of the glass vessel 10'.

Figure 4:
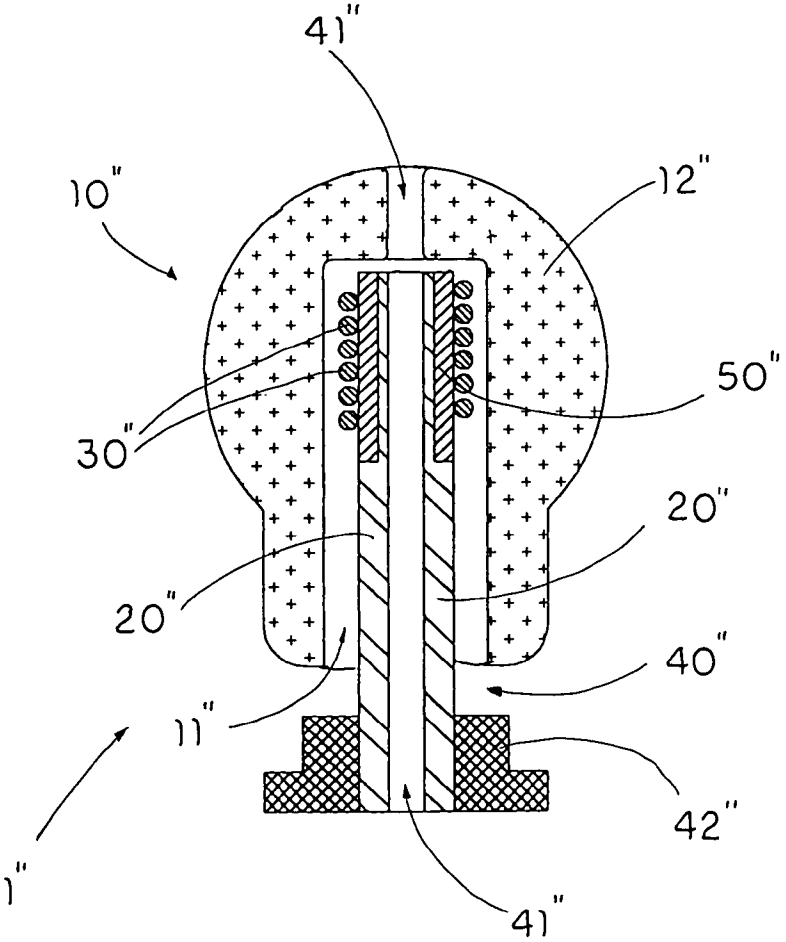
FIG. 4 is second alternative mode of an electrodeless fluorescent lamp according to a above first preferred embodiment of the present invention.

Referring to FIG. 4 of the drawings, an electrodeless fluorescent lamp 1" according to a second alternative mode of the first preferred embodiment of the present invention is illustrated. The second alternative mode is similar to the first preferred embodiment except that the ventilating channel 11" is longitudinally extended across the glass vessel 10" to an outside thereof. In other words, the ventilation channel 11" is extended to reach an outside of the glass vessel 10" through an bottom end and an upper end of the glass vessel 10".

Figure 5:
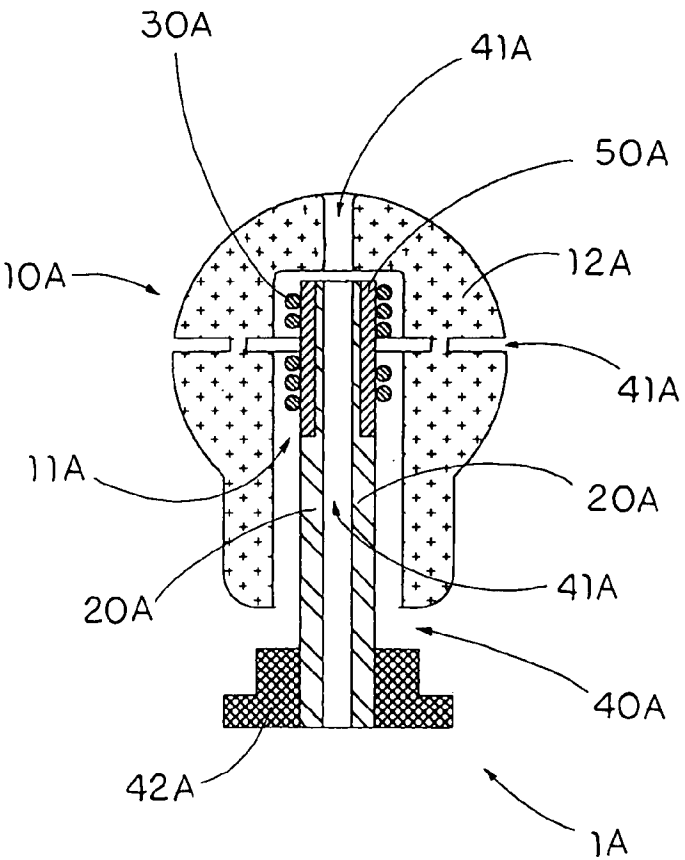
FIG. 5 is third alternative mode of an electrodeless fluorescent lamp according to the above first preferred embodiment of the present invention.

Referring to FIG. 5 of the drawings, an electrodeless fluorescent lamp 1" according to a third alternative mode of the first preferred embodiment of the present invention is illustrated. The third alternative mode is similar to the first preferred embodiment except that the ventilation arrangement 40A further contains a plurality of transverse ventilation channels 41A extended along the glass vessel 10A to an outside thereof in its transverse direction from the induction coil 20A for providing enhanced heat ventilation. Specifically, the transverse ventilation channel 41A is adapted to convect more air to the central portion of the glass vessel 10A and remove more heat therefrom.

Figure 6:
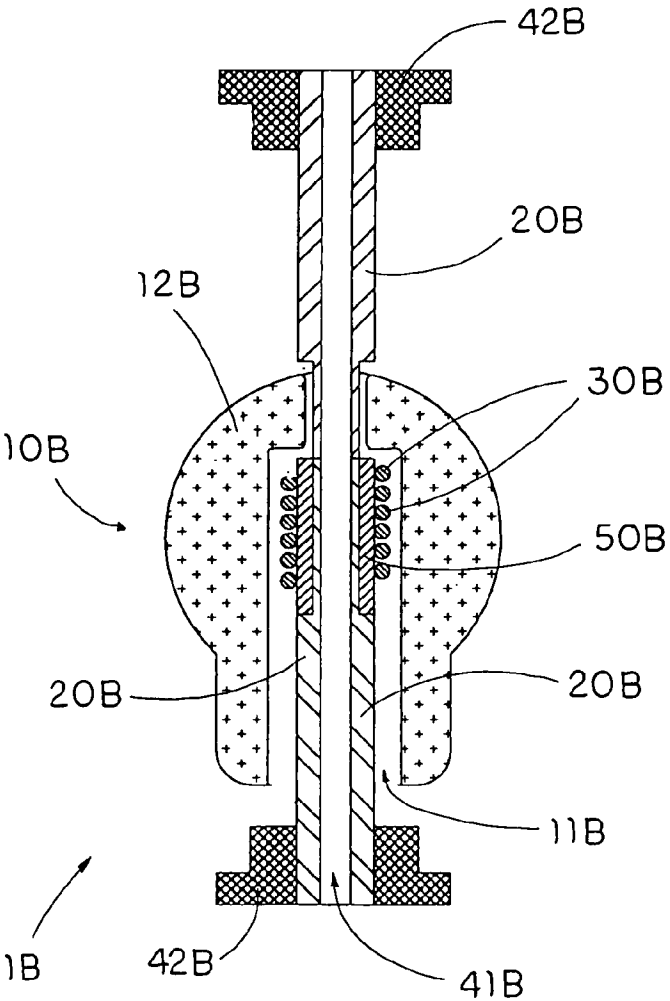
FIG. 6 is a fourth alternative mode of an electrodeless fluorescent lamp according to the above first preferred embodiment of the present invention.

Referring to FIG. 6 of the drawings, an electrodeless fluorescent lamp 1B according to a fourth alternative mode of the first preferred embodiment of the present invention is illustrated. The fourth alternative mode is similar to the first preferred embodiment except that the ventilation channel 41B is longitudinally extended out of the glass vessel 10 from both a bottom portion and a top portion thereof, wherein the ventilation arrangement 41B further comprises one more heat ventilating base 42B mounted on a top portion of the ventilation channel 41B for removing more heat from the center of the glass vessel, i.e. the induction coil 30B.

Therefore, the thermal conductive unit 20B is upwardly extended from the upper end of the glass vessel to reach the additional heat ventilating base 42B.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An electrodeless fluorescent lamp, comprising:

a glass vessel having a retention channel and a vapor chamber for sealedly storing an active vapor therein;

a thermal conductive unit disposed within said retention channel;

an induction coil supported by said thermal conductive unit within said retention channel, wherein said induction coil is arranged to generate heat towards said vapor chamber for emitting light from said active vapor; and a ventilation arrangement having a ventilation channel enclosed by said glass vessel to extend from said retention channel to an exterior of said glass vessel for ventilating excess heat from said induction coil within said retention channel to outside of said glass vessel.

2. The electrodeless fluorescent lamp, as recited in claim 1, wherein said ventilation channel is longitudinally and downwardly extended from said retention channel to an outside of said glass vessel through a bottom end of said ventilation channel.

3. The electrodeless fluorescent lamp, as recited in claim 2, wherein said ventilation arrangement further comprises a heat ventilating heat reservoir provided at a bottom end portion of said ventilating channel wherein heat from said induction coil is arranged to be transferred to said ventilating heat reservoir which facilitates enhanced heat transfer between said ventilation channel and an outside of said glass vessel.

4. The electrodeless fluorescent lamp, as recited in claim 1, wherein said ventilation channel is formed and longitudinally extended along said thermal conductive unit which also extends to reach an outside of said glass vessel through a bottom end of said retention channel.

5. The electrodeless fluorescent lamp, as recited in claim 4, further comprising a ferrite conductor supported by said thermal conductive unit and contacted with said induction coil, wherein said ferrite conductor is adapted to facilitate high-frequency energy transfers between said thermal conductive unit and said induction coil.

6. The electrodeless fluorescent lamp, as recited in claim 3, wherein said ventilation channel is formed and longitudinally extended along said thermal conductive unit which also extends to reach an outside of said glass vessel through a bottom end of said retention channel.

7. The electrodeless fluorescent lamp, as recited in claim 6, further comprising a ferrite conductor supported by said thermal conductive unit and contacted with said induction coil, wherein said ferrite conductor is adapted to facilitate high-frequency energy transfers between said thermal conductive unit and said induction coil.

8. The electrodeless fluorescent lamp, as recited in claim 3, wherein said ventilating heat reservoir is a heat sink which is capable of facilitating said enhanced heat transfer between said ventilation channel and an outside of said glass vessel.

9. The electrodeless fluorescent lamp, as recited in claim 8, wherein said ventilation channel is formed and longitudinally extended along said thermal conductive unit which also extends to reach an outside of said glass vessel through a bottom end of said retention channel.

10. The electrodeless fluorescent lamp, as recited in claim 9, further comprising a ferrite conductor supported by said thermal conductive unit and contacted with said induction coil, wherein said ferrite conductor is adapted to facilitate high-frequency energy transfers between said thermal conductive unit and said induction coil.

11. The electrodeless fluorescent lamp, as recited in claim 9, further comprising a supporting base mounted at a bottom portion of said glass vessel wherein said ventilation arrangement further contains a plurality of convecting holes formed on said supporting base and said thermal conductive unit such that air from said ventilation channel is adapted to pass through said convecting holes to reach an exterior of said glass vessel.

12. The electrodeless fluorescent lamp, as recited in claim 11, further comprising a ferrite conductor supported by said thermal conductive unit and contacted with said induction coil, wherein said ferrite conductor is adapted to facilitate high-frequency energy transfers between said thermal conductive unit and said induction coil.

13. The electrodeless fluorescent lamp, as recited in claim 9, wherein said ventilation channel is also upwardly and longitudinally extended to reach an outside of said glass vessel through an upper end of said glass vessel.

14. The electrodeless fluorescent lamp, as recited in claim 13, further comprising a ferrite conductor supported by said thermal conductive unit and contacted with said induction coil, wherein said ferrite conductor is adapted to facilitate high-frequency energy transfers between said thermal conductive unit and said induction coil.

15. The electrodeless fluorescent lamp, as recited in claim 9, wherein said ventilation arrangement further contains a plurality of transverse ventilation channels transversely extended along said glass vessel from said induction coil to an outside of said glass vessel so as to provide enhanced heat ventilation through said transverse ventilation channels.

16. The electrodeless fluorescent lamp, as recited in claim 15, further comprising a ferrite conductor supported by said thermal conductive unit and contacted with said induction coil, wherein said ferrite conductor is adapted to facilitate high-frequency energy transfers between said thermal conductive unit and said induction coil.

17. The electrodeless fluorescent lamp, as recited in claim 9, wherein said ventilation channel is longitudinally and upwardly extended from said retention channel to an outside of said glass vessel through an upper end of said glass vessel, wherein said ventilation arrangement further comprises one more heat ventilating base mounted on a top portion of said ventilation channel for removing heat from said induction coil and said ferrite conductor.

18. The electrodeless fluorescent lamp, as recited in claim 17, wherein said ventilation channel is formed in said thermal conductive unit which is also upwardly and longitudinally extended to reach said additional heat ventilating base through said upper end of said glass vessel.

19. The electrodeless fluorescent lamp, as recited in claim 18, further comprising a ferrite conductor supported by said thermal conductive unit and contacted with said induction coil, wherein said ferrite conductor is adapted to facilitate high-frequency energy transfers between said thermal conductive unit and said induction coil.

20. The electrodeless fluorescent lamp, as recited in claim 17, further comprising a ferrite conductor supported by said thermal conductive unit and contacted with said induction coil, wherein said ferrite conductor is adapted to facilitate high-frequency energy transfers between said thermal conductive unit and said induction coil.

* * * * *